US009765653B2

(12) United States Patent
Kajiura et al.

(10) Patent No.: US 9,765,653 B2
(45) Date of Patent: Sep. 19, 2017

(54) VALVE TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventors: Mikihiro Kajiura, Tama (JP); Yosuke Iwase, Yokohama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 20 days.

(21) Appl. No.: 14/931,341

(22) Filed: Nov. 3, 2015

(65) Prior Publication Data

US 2016/0123194 A1 May 5, 2016

(30) Foreign Application Priority Data

Nov. 4, 2014 (JP) ..... 2014-223932

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC ..... F01L 1/344
See application file for complete search history.

(56) References Cited

U.S. PATENT DOCUMENTS 8,899,197 B2 12/2014 Kokubo et al.
2011/0253085 A1 10/2011 Kokubo et al.

FOREIGN PATENT DOCUMENTS

JP 2011-226372 A 11/2011

*Primary Examiner* — Zelalem Eshete
(74) *Attorney, Agent, or Firm* — Foley & Lardner LLP

(57) ABSTRACT

A valve timing control apparatus for an internal combustion engine includes a driving rotation member to which rotation of a crankshaft is transmitted, a driven rotation member coupled to a camshaft so as to be rotatable relative to the driving rotation member, an electric motor having a motor output shaft to cause rotation of the driven rotation member relative to the driving rotation member, a cover member arranged axially facing a front end portion of the motor output shaft and an electromagnetic induction type rotational angle detection mechanism disposed between the motor output shaft and the cover member so as to detect a rotational angle of the motor output shaft. The rotational angle detection mechanism has a detected part provided to the front end portion of the motor output shaft and a detecting part provided to a portion of the cover member axially facing the detected part.

11 Claims, 17 Drawing Sheets

VALVE TIMING CONTROL APPARATUS FOR INTERNAL COMBUSTION ENGINE

BACKGROUND OF THE INVENTION

The present invention relates to a valve timing control device for controlling the opening and closing timing of an intake or exhaust valve in an internal combustion engine.

It is herein noted that, in the following description, the terms "front", "rear" and other orientational expressions are used to facilitate the description of a valve timing control apparatus and are not intended to limit the structure of a valve timing control apparatus to any particular position or orientation.

Japanese Laid-Open Patent Publication No. 2011-226372 discloses a valve timing control apparatus for controlling the opening and closing timing of an engine valve in an internal combustion engine. The valve control apparatus includes an electric motor accommodated in a motor housing, a cover member attached to a front side of the motor housing, with a predetermined clearance left between the motor housing and the cover member, and a pair of power-supply slip rings fixed to an inner side of the cover member at positions facing the clearance. The electric motor has a power-supply plate fixed at a front end portion of the motor housing and a power-supply brush held on the power-supply plate in sliding contact with the power-supply slip rings to supply power to a coil of the electric motor via the power-supply slip lings. The valve control apparatus further includes a magnetic sensor disposed between an output shaft of the electric motor and a motor-side portion of the cover member to detect a rotational angle of the motor output shaft. The magnetic sensor has a magnetic rotor provided with six targets on the front end portion of the motor output shaft and a Hall element detector provided in the cover member to retrieve a pulse signal through the six targets of the magnetic rotor such that that the rotational angle of the motor output shaft can be detected according to the pulse signal. By the adoption of such a configuration, the variable valve control apparatus controls the relative rotational phase of crankshaft and camshaft based on the rotational angle of the motor output shaft so as to improve the stability and response of control of the valve timing while reducing the consumption energy of the internal combustion engine.

SUMMARY OF THE INVENTION

In the above-conventional valve timing control apparatus, however, the magnetic sensor receives the influence of a magnetic field caused by the electric motor. In addition, the magnetic sensor cannot detect that the rotational angle of the motor output shaft unless the motor output shaft is rotated by at least one turn, i.e., cannot detect the rotational angle of the motor output shaft during e.g. engine idling stop.

In view of these technical problems, it is an object of the present invention to provide a valve timing control apparatus for an internal combustion engine, which utilizes an electromagnetic induction type angle sensor as a rotational angle detection mechanism so as to avoid the influence of a magnetic field caused by an electric motor and accurately detect the rotational angle of an output shaft of the electric motor.

According to one aspect of the present invention, there is provided a valve timing control apparatus for an internal combustion engine, comprising: a driving rotation member to which rotation of a crankshaft is transmitted; a driven rotation member coupled to a camshaft so as to be rotatable relative to the driving rotation member; an electric motor having a motor output shaft to cause rotation of the driven rotation member relative to the driving rotation member; a cover member arranged axially facing a front end portion of the motor output shaft; and an electromagnetic induction type rotational angle detection mechanism disposed between the motor output shaft and the cover member so as to detect a rotational angle of the motor output shaft, wherein the rotational angle detection mechanism comprises: a detected part provided to the front end portion of the motor output shaft; and a detecting part provided to a portion of the cover member axially facing the detected part.

According to another aspect of the present invention, there is provided a valve timing control apparatus for an internal combustion engine, comprising: a driving rotation member to which rotation of a crankshaft is transmitted; a driven rotation member coupled to a camshaft by a cam bolt so as to be rotatable relative to the driving rotation member; an electric motor integrally mounted on the driving rotation member and having a motor rotation shaft rotated to cause rotation of the driven rotation member relative to the driving rotation member; a cover member arranged axially facing a front end portion of the motor output shaft; and an electromagnetic induction type rotational angle detection mechanism disposed between the motor output shaft and the cover member so as to detect a rotational angle of the motor output shaft, wherein the rotational angle detection mechanism comprises: a detected part provided to the front end portion of the motor output shaft and having an exciting conductor fixed to a front end face of the detected part; a circuit board fixed to the cover member; receiving and exciting coils mounted on the circuit board; and a detection circuit mounted on the circuit board to detect a change in inductance between the receiving coil and the exciting conductor and determine the rotational angle of the motor output shaft based on the detected change in inductance.

It is possible in the present invention to avoid the influence of a magnetic field caused by the electric motor and accurately detect the rotational angle of the motor output shaft with increase of detection resolution.

The other objects and features of the present invention will also become understood from the following description.

DESCRIPTIONS OF THE EMBODIMENTS

Hereinafter, the present invention will be described by way of the following embodiments with reference to the drawings. Each of the following embodiments refers to a valve timing control apparatus operated under the control of a control unit so as to control the opening and closing timing of intake valves in an internal combustion engine.

[First Embodiment]

Figure 1:
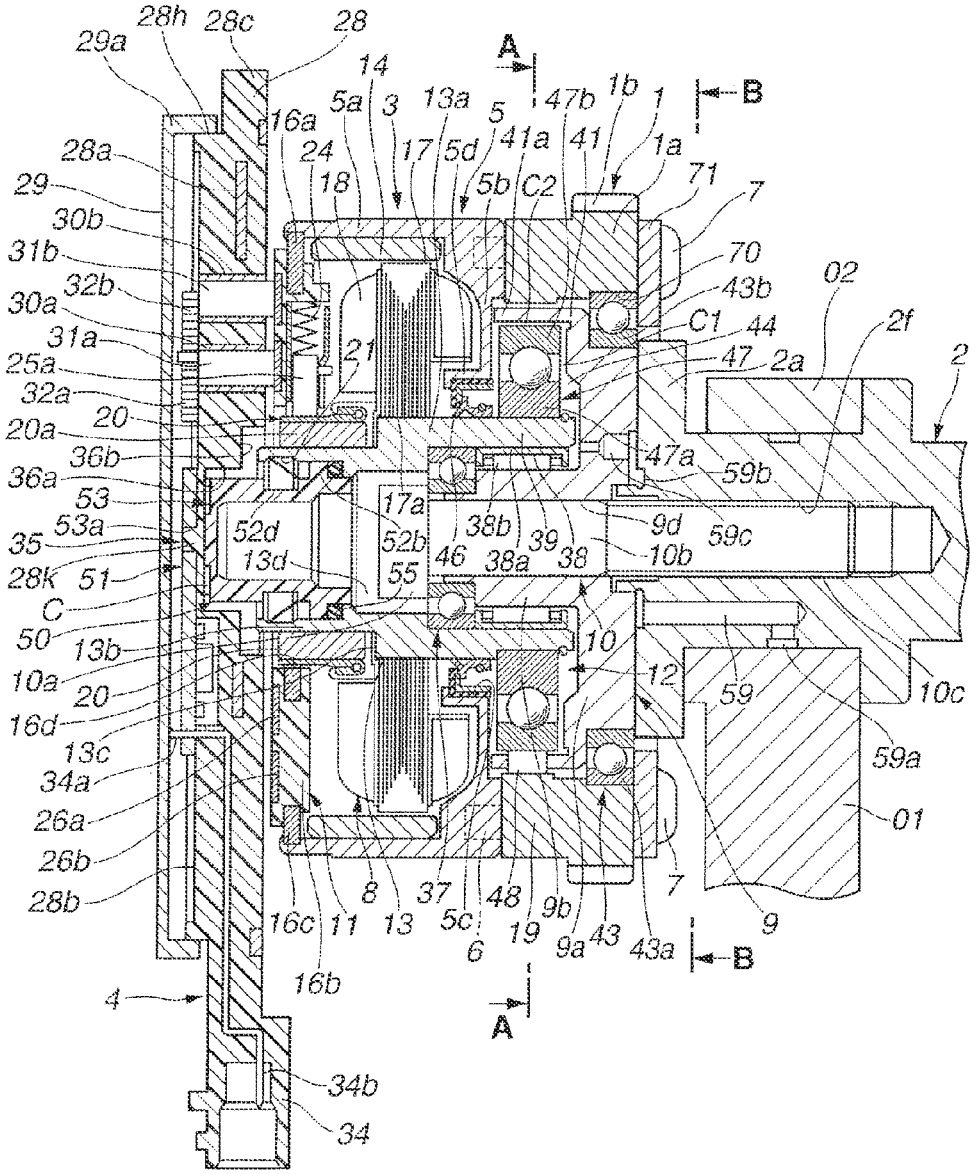
FIG. 1 is a cross section view of a valve timing control apparatus according to a first embodiment of the present invention.
Figure 2:
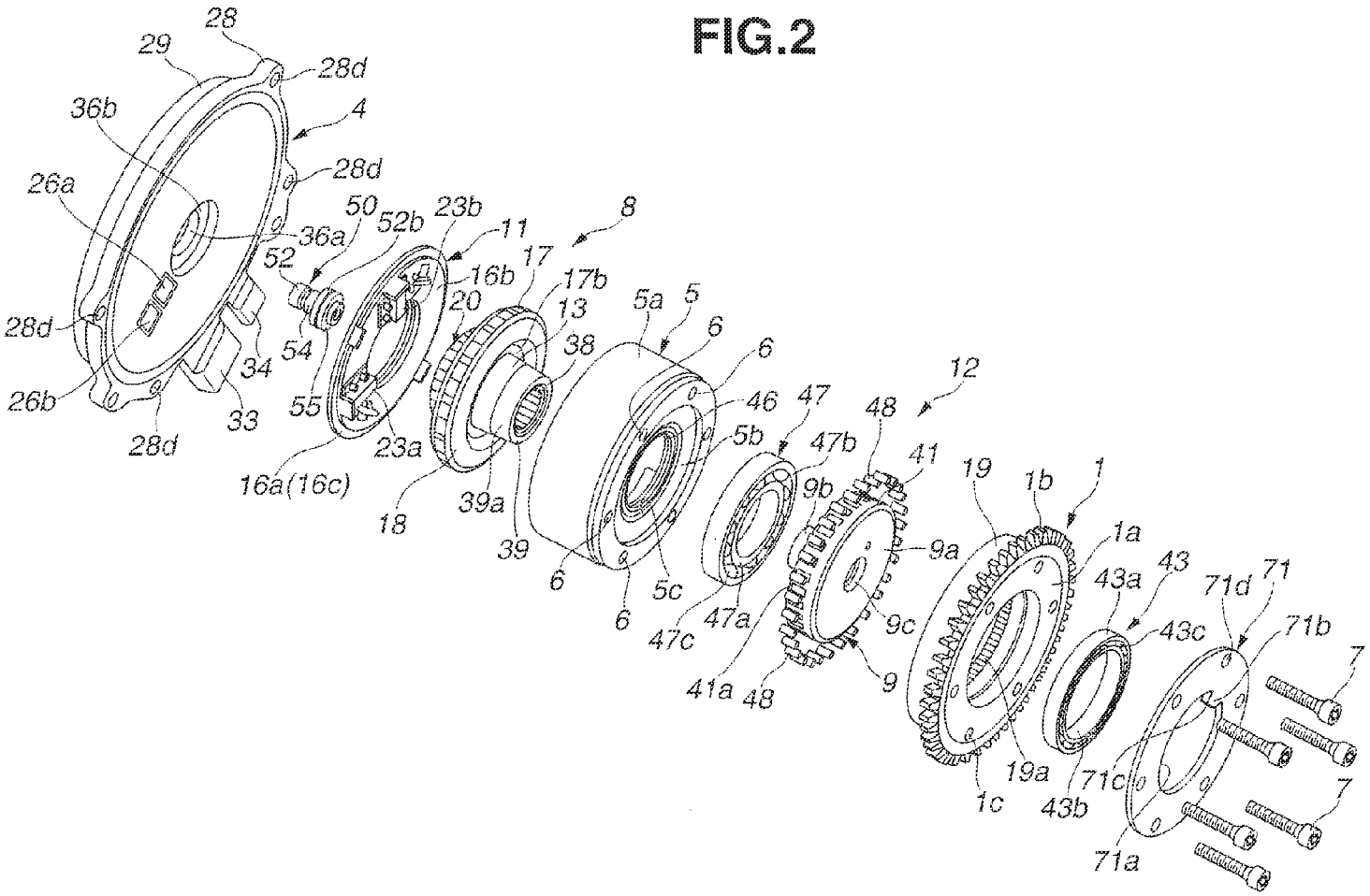
FIG. 2 is an exploded perspective view of main components of the valve timing control apparatus according to the first embodiment of the present invention.

As shown in FIGS. 1 and 2, the valve timing control apparatus has a timing sprocket 1 (as a driving rotation member) rotated by a crankshaft of the internal combustion engine, a camshaft 2 rotatably supported on a cylinder head 01 of the internal combustion engine via a bearing 02 and rotated by rotation of the timing sprocket 1, a phase change mechanism 3 arranged between the timing sprocket 1 and the camshaft 2 and equipped with an electric motor 8 and a reduction gear unit 12 to change the relative rotational phase of the timing sprocket 1 (crankshaft) and the camshaft 2, a cover member 4 arranged on a front end side of the phase change mechanism 3 and an angle sensor 35 (as a rotational angle detection mechanism) disposed adjacent to the electric motor 8 to detect a rotational angle of the electric motor 8.

The timing sprocket 1 is made of an iron-based metal material and includes an annular sprocket body 1*a* having an inner circumferential surface with stepped diameters, an external gear part 1*b* formed integrally on an outer circumference of the sprocket body 1*a* and a cylindrical integral gear part 19 formed integrally on a front end of the sprocket body 1*a* and protruding toward the front of the phase change mechanism 3. An annular groove is cut as a ring fitting region 70 in an inner circumference of the sprocket body 1*a* so as to be open toward the camshaft 2. A timing chain (not shown) is wound around the external gear part 1*b* such that the rotation of the crankshaft is transmitted to the timing sprocket 1 through the timing chain. A plurality of corrugated internal gear teeth 19*a* are cut in an inner circumference of the internal gear part 19.

A large-diameter ball bearing 43 is disposed between the sprocket body 1*a* and a driven member 9 (as a driven rotation member) of the reduction gear unit 12, which is arranged on a front end portion of the camshaft 2, such that the timing sprocket 1 is relatively rotatably supported around an outer circumference of the driven member 9 via the large-diameter ball bearing 43.

As shown in FIG. 2, the large-diameter ball bearing 43 is of the ordinary type, having an outer ring 43*a* axially press-fitted in the ring fitting region 70 of the sprocket body 1*a*, an inner ring 43*b* press-fitted on a rear end portion (also referred to as "fixing end portion 9*a*") of the driven member 9 and a plurality of balls 43*c* interposed between the outer ring 43*a* and the inner ring 43*b*.

Figure 4:
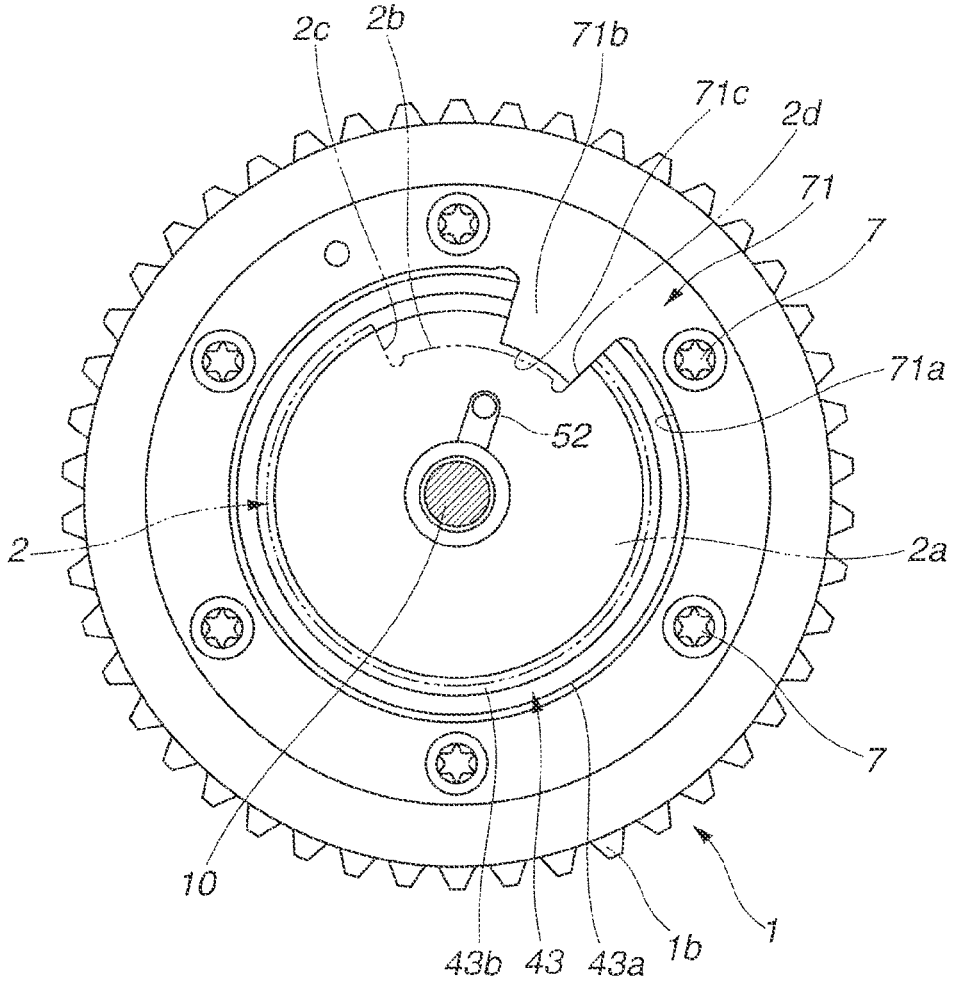
FIG. 4 is a cross section view of the valve timing control apparatus, as taken along line B-B of FIG. 1, according to the first embodiment of the present invention.

An annular metallic retaining plate 71 is disposed on a rear end of the sprocket body 1*a*, with an inner circumferential portion 71*a* of the retaining plate 71 being brought into contact with a rear end face of the outer ring 43*a*. As shown in FIGS. 1 and 4, an outer diameter of the retaining plate 71 is set substantially equal to an outer diameter of the sprocket body 1*a*; and an inner diameter of the retaining plate 71 is set smaller than an outer diameter of the outer ring 43*a* of the large-diameter ball bearing 43.

A stopper protrusion 71*b* is integrally formed in a sector shape at a predetermined position on the inner circumferential portion 71*a* of the retaining plate 71 so as to protrude radially inwardly toward the center axis of the camshaft 2. A radial tip end 71*c* of the stopper protrusion 71 is curved into a circular arc shape.

Six bolt insertion holes 1*c*, 71*d* are formed in each of outer peripheral edge regions of the sprocket body 1*a* and the retaining plate 71 at circumferentially equally spaced positions for insertion of bolts 7.

Herein, the sprocket body 1*a* and the internal gear part 19 constitute a casing of the reduction gear unit 12. Further, the sprocket body 1*a*, the internal gear part 19, the retaining plate 71 and a motor housing 5 of the electric motor 8 are set substantially equal in outer diameter.

The motor housing 5 includes a housing body 5*a* formed by pressing an iron-based metal material into a bottomed circular cylindrical shape and a power-supply plate 11 closing a front opening end of the housing body 5*a* as shown in FIG. 1.

The housing body 5*a* has a circular plate-shaped partition wall 5*b* at a rear end thereof. A large-diameter shaft insertion hole 5*c* is formed in substantially the center of the partition wall 5*b* such that an eccentric shaft part 39 of the reduction gear unit 12 is inserted through the insertion hole 5*c*. The housing body 5*a* also has a cylindrical extension portion 5*d* formed integrally on a peripheral edge of the shaft insertion hole 5*c* so as to protrude toward the front in the axial direction of the camshaft 2.

Six female thread holes 6 are axially formed in an outer peripheral edge region of the partition wall 5*b* at positions corresponding to the bolt insertion holes 1*c* and 71*d*.

By insertion of the bolts 7 through the bolt insertion holes 1*c* and 7*d* and screwing of the bolts 7 into the female thread holes 6, the timing sprocket 1 and the retaining plate 71 are axially fastened together to the motor housing 5, with a rear end face of the partition wall 5*b* of the housing body 5*a* being axially brought into contact with a front end of the internal gear part 19.

The camshaft 2 is equipped with a pair of drive cams per cylinder to operate the intake valves. As shown in FIG. 1, a flange portion 2*a* is formed integrally on a front end of the camshaft 2 and axially coupled to the driven member 9 by a cam bolt 10, with a front end face of the flange portion 2*a* being brought into contact with a rear end face of the fixing end portion 9*a* of the driven member 9. An outer diameter of the flange portion 2*a* is set slightly larger than an outer diameter of the fixing end portion 9*a* of the driven member 9 such that, after assembling of the respective structural components, an outer peripheral edge of the front end face of the flange portion 2*a* is brought into contact with a rear end face of the inner ring 43*b* of the large-diameter ball bearing 43. A female thread 2*f* is cut in an inner circumference of the cam shaft 2 from the front end toward the inside of the cam shaft 2.

As shown in FIG. 4, a stopper groove 2*b* is formed in an outer circumference of the flange portion 2*b* such that the stopper protrusion 71*b* of the retaining plate 71 engages in the stopper groove 2*b*. As the stopper groove 2*b* is curved into a circular arc shape with a predetermined length along a circumferential direction of the flange portion 2*b*, the stopper protrusion 71*b* is movable within the length of the stopper recess 2*b*. The maximum advanced and retarded rotational positions of the camshaft 2 relative to the timing sprocket 1 can be thus restricted by contact of side edges of the stopper protrusion 71*b* with circumferentially opposing edges 2*c* of the stopper recess 2*b*.

In the first embodiment, the stopper protrusion 71*b* is located at a position closer to the camshaft 2 than and apart from a region of the retaining plate 71 axially facing and fitted to the outer ring 43*a* of the large-diameter ball bearing 43. Thus, the stopper protrusion 71*b* can be kept from contact with the fixing end portion 9*a* of the driven member 9 and thereby prevented from interfering with the fixing end portion 9*a* of the driven member 9.

As shown in FIG. 1, the cam bolt 10 has a bolt head portion 10*a* and a shaft portion 10*b*. A male thread 10*c* is cut in an outer circumference of the shaft portion 10*b* for screwing into the female thread 2*f* of the camshaft 2.

The phase change mechanism 3 is equipped with the electric motor 8 and the reduction gear unit 12 as mentioned above.

In the reduction gear unit 12, the driven member 9 is made of an iron-based metal material and includes, in addition to the fixing end portion 9*a*, a circular cylindrical portion 9*b*. The fixing end portion 9*a* is formed in a circular plate shape and located adjacent to the camshaft 2. As mentioned above, the rear end face of the fixing end portion 9*a* is axially brought into contact with and press-fixed to the front end face of the flange portion 2*a* of the camshaft 2 by axial force of the cam bolt 10. The circular cylindrical portion 9*b* is formed so as to axially protrude from the center of a front end face of the fixing end portion 9*a*. A bolt insertion hole 9*d* is formed in the center of the circular cylindrical portion 9*b* such that the shaft portion 10*b* of the cam bolt 10 is inserted through the bolt insertion hole 9*d*.

The electric motor 8 is arranged on a front end side of the circular cylindrical portion 9*b* of the driven member 9. As shown in FIGS. 1 and 2, the electric motor 8 is in the form of a brush DC motor. In the electric motor 8, the motor housing 5, which is constituted by the housing body 5*a* and the power-supply plate 11 and fastened to the timing sprocket 1 as mentioned above, rotates together with the timing sprocket 1 and functions as a yoke.

The electric motor 8 has a motor output shaft 13 rotatably disposed in the motor housing 5.

A bolt insertion hole 13*d* is formed axially through the motor output shaft 13 such that the cam bolt 10 is inserted in the bolt insertion hole 13*d*. A circumferential wall of the motor output shaft 13 is formed into a stepped circular cylindrical shape and is adapted as an armature.

Figure 7A:
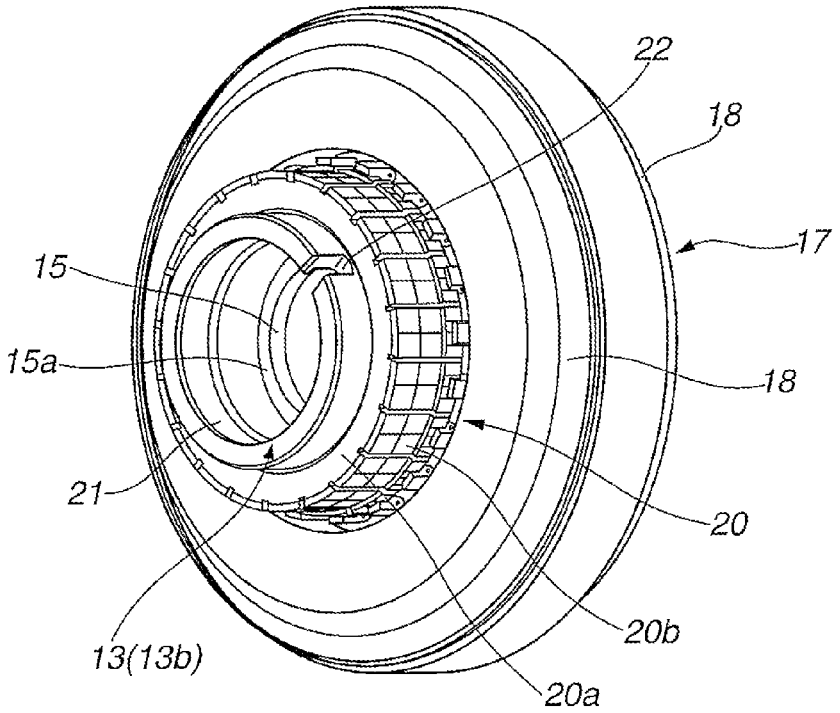
FIGS. 7A and 7B are a perspective view and a cross section view of a motor output shaft and an iron-core rotor of an electric motor of the valve timing control apparatus according to the first embodiment of the present invention, respectively.
Figure 7B:
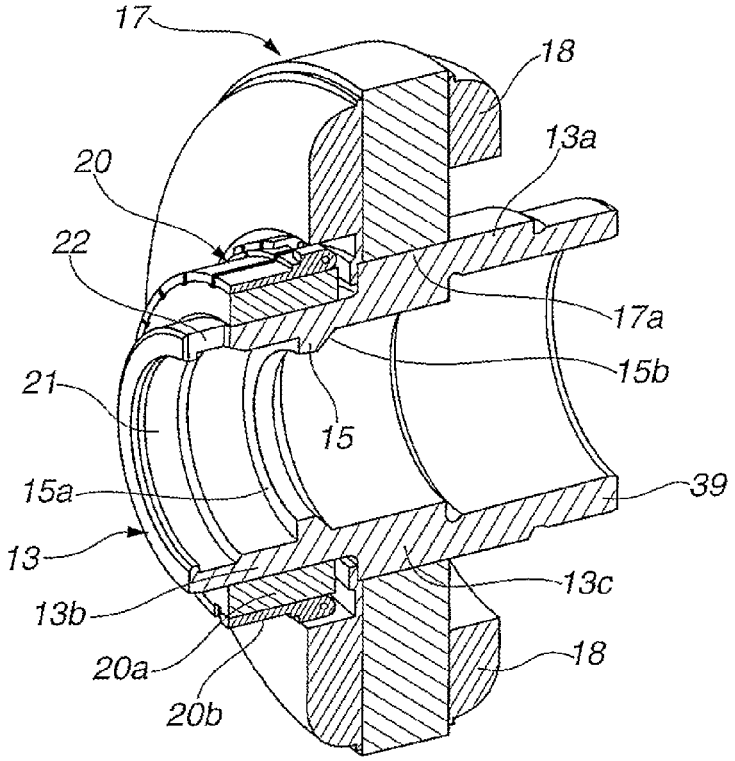

As shown in FIGS. 1 and 7B, the motor output shaft 13 has a rear end portion 13*a* made relatively large in diameter (hereinafter referred to as "large-diameter portion"), a front end portion 13*b* made relatively small in diameter (hereinafter referred to as "small-diameter portion") and a stepped portion 13*c* located at a substantially axially middle position between the large-diameter portion 13*a* and the small-diameter portion 13*b*. The large-diameter portion 13*a* of the motor output shaft 13 is made integral at a rear end thereof with the eccentric shaft part 39 of the reduction gear unit 12.

An annular protrusion 15 is formed integrally on an inner circumferential surface of the small-diameter portion 13*b* at a position adjacent to stepped portion 13*c* as shown in FIGS. 7A and 7B. The annular protrusion 15 is substantially rectangular in cross section, with a front end face 15*a* thereof extending vertically and a rear end face 15*b* thereof extending in a tapered shape.

A locking groove 21 is formed, in an annular shape with a predetermined width, in a front end region of the inner circumferential surface of the small-diameter portion 13*b*.

A positioning groove 22 is formed in the inner circumferential surface of the small-diameter portion 13*b* so as to axially extend in an elongated rectangular shape up to the width of the locking groove 21.

The electric motor 8 also includes an iron-core rotor 17 fixed to an outer circumference of the large-diameter portion 13*a* of the motor output shaft 13, a commutator 20 press-fitted around an outer circumference of the small-diameter portion 13*b* of the motor output shaft 13 and four semi-circular arc-shaped permanent magnets 14 fixed as a stator to an inner circumference of the housing body 5*a*.

The iron-core rotor 17 has a magnetic body with a plurality of magnetic poles. An outer circumferential portion of the iron-core rotor 17 is adapted as a bobbin having a slot in which a coil 18 is wound. An inner circumferential portion of the iron-core rotor 17 is axially positioned by and fixed to the stepped portion 13*c* of the motor output shaft 13.

The commutator 20 has an annular ring part 20*a* and an annular electrode part 20*b* arranged on an outer circumference of the annular ring part 20*a*. An outer diameter of the annular ring part 20*a* is set substantially equal to an outer diameter of the large-diameter portion 13*a*. The annular ring part 20*a* is located at a substantially axially middle position of the small-diameter portion 13*b*. The electrode part 20*b* is formed of a conductive material in an annular shape and is divided into the same number of segments as the magnetic poles of the iron-core rotor 17. To these segments of the electrode part 20*b*, wire ends of the coil 18 are electrically connected.

The permanent magnets 14 are combined together into a cylindrical shape with a plurality of magnetic poles arranged circumferentially. As shown in FIG. 1, the permanent magnets 14 are axially deviated (offset) toward the power-supply plate 11 with respect to the center of the iron-core rotor 17.

Figure 5:
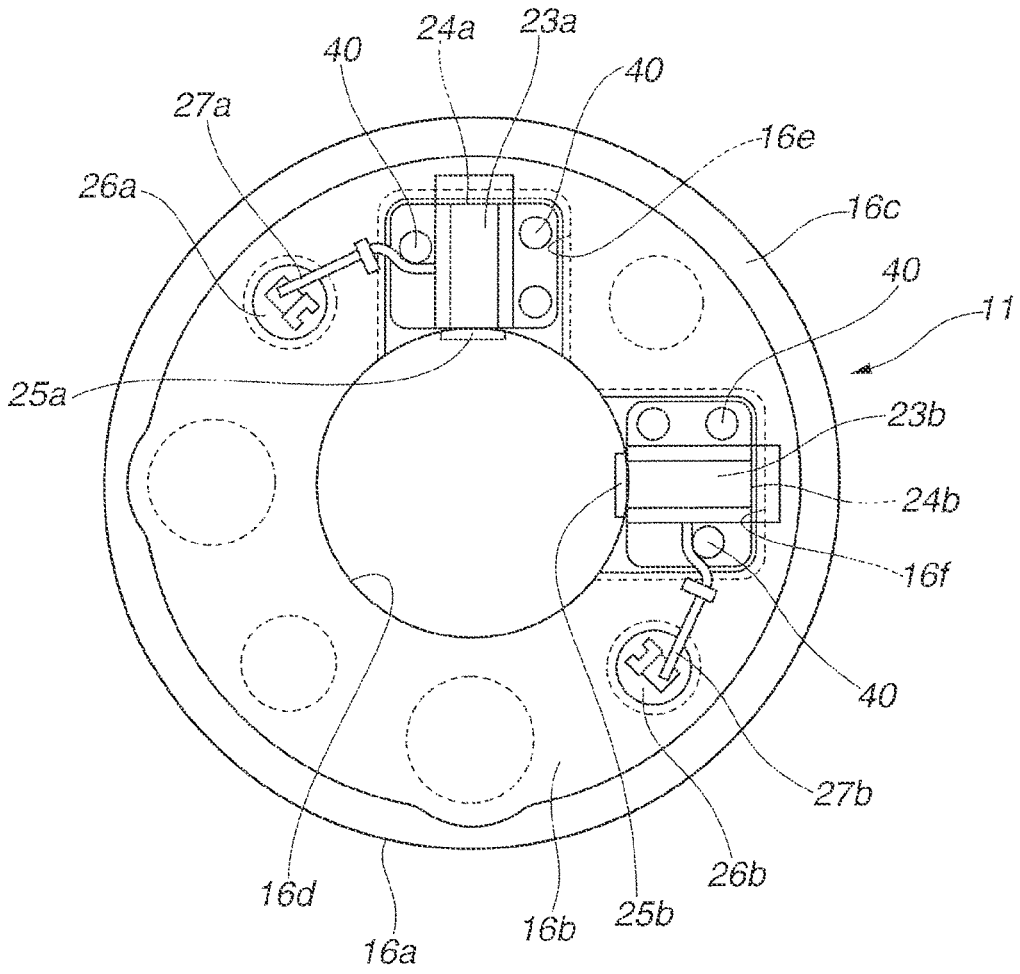
FIG. 5 is a back view of a power-supply plate of the valve timing control apparatus according to the first embodiment of the present invention.

As shown in FIGS. 1 and 5, the power-supply plate 11 has a disc-shaped metal plate 16*a* made of an iron-based metal material and a disc-shaped resin part 16*b* molded on front and rear sides of the metal plater 16*a*. Herein, the power-supply plate 11 constitutes a part of power supply to the electric motor 8.

An outer circumferential portion 16*c* of the metal plate 16*a*, which is not covered by the resin part 16*b*, is fixed in position by crimping in an annular stepped recess of the front end of the motor housing 5. A shaft insertion hole 16*d* is formed through a center portion of the metal plate 16*a* such that a front end region of the motor output shaft 13 (small-diameter portion 13*b*) is inserted in the shaft insertion hole 16*d*. Two retaining holes 16*e* and 16*f* of different shapes are formed by stamping in the metal plate 16*a* at predetermined positions continuous with a peripheral edge of the shaft insertion hole 16*d* as shown in FIG. 5.

In the power-supply plate 11, a pair of copper brush holders 23*a* and 23*b* are retained in the retaining holes 16*e* and 16*f* of the metal plate 16*a* and fixed to a front end portion of the resin part 16*b* by a plurality of rivets 40.

A pair of switching brushes 25*a* and 25*b* (as a commutator) are radially slidably held in the brush holders 23*a* and 23*b*, with arc-shaped radial ends thereof being elastically brought into contact with an outer circumferential surface of the commutator 20 by coil springs 24*a* and 24*b*. These switching brushes 25*a* and 25*b* radially overlap in position with front end portions of the permanent magnets 14 as the permanent magnets 14 are axially deviated (offset) toward the power-supply plate 11 with respect to the center of the iron-core rotor 17 as mentioned above.

Inner and outer power-supply slip rings 26*a* and 26*b*, each of which is formed by stamping a thin copper plate into an annular shape, are mold-fixed in the front end portion of the resin part 16*b*, with outer lateral surfaces thereof being exposed to the outside, and are electrically connected to the switching brushes 25*a* and 25*b* by harnesses 27*a* and 27*b*.

Figure 6:
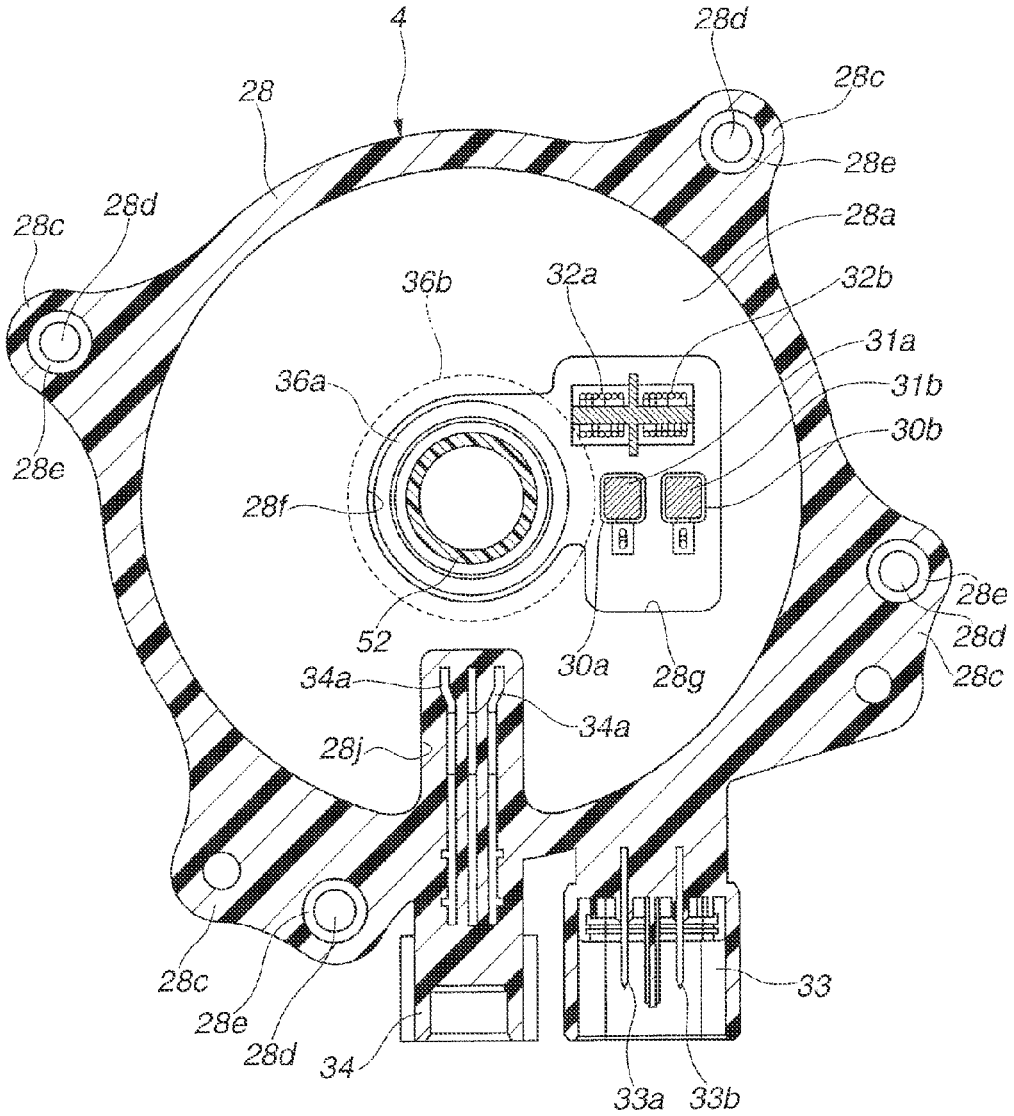
FIG. 6 is a cross section view of a cover member of the valve timing control apparatus according to the first embodiment of the present invention.

As shown in FIGS. 1 and 6, the cover member 4 is substantially disc-shaped and located on a front end side of the power-supply plate 11 so as to close the front end of the motor housing 5. The cover member 4 includes a disc plate-shaped cover body 28 formed of a synthetic resin material with a predetermined thickness and a disc-shaped cap 29 formed of a synthetic resin material and covering a front end region of the cover body 28. An outer diameter of the cover body 28 is set larger than an outer diameter of the housing body 5*a*.

A substantially disc-shaped reinforcing plate 28*a* of metal material is molded as a metal core in the cover body 28. A circular through hole 28*f* is formed through the center of the reinforcing plate 28*a*. A substantially rectangular window hole 28*g* is formed through the reinforcing plate 28*a* at a position on one lateral side (right side in FIG. 6) of the through hole 28*f*. An elongated cut 28*j* is formed in the reinforcing metal plate 28*a* at a position on another side (lower side in FIG. 6) of the through hole 28*f*. A stepped engagement recess 28*h* is formed in an outer circumferential portion of the cover body 28.

An engagement protrusion 29*a* is integrally formed on an outer circumferential portion of the cap 29 such that the cap 29 is attached to the cover body 28 by press-fitting of the engagement protrusion 29*a* into the engagement recess 28*h*.

Furthermore, metal sleeves 28*e* are molded in four arc-shaped protruding peripheral boss portions 28*c* of the cover body 28 such that bolts are inserted in respective bolt insertion holes 28*d* of the metal sleeves 28*e* for fixing of the cover ember 4 to a chain cover.

In the cover member 4, a pair of rectangular cylindrical brush holders 30*a* and 30*b* are fixed in the cover body 28 at positions within the window hole 28*g* and axially corresponding to the slip rings 26*a* and 26*b*.

A pair of power-supply brushes 31*a* and 31*b* are axially slidably held in the brush holders 30*a* and 30*b*. Each of the power-supply brushes 31*a* and 31*b* has a rectangular column shape with a predetermined axial length. Tip end portions of the power-supply brushes 31*a* and 31*b* are movable back and forth through rear opening ends of the brush holders 30*a* so as to allow sliding contact of the power-supply brushes 31*a* and 31*b* (more specifically, flat end faces of the power-supply brushes 31*a* and 31*b*) with the slip ring 26*a*, 26*b*, whereas base end portions of the power-supply brushes 31*a* and 31*b* are integrally molded with end portions of pigtail harnesses through front opening ends of the brush holders 30*a* and 30*b*.

Torsion coil springs 32*a* and 32*b* are disposed on a front surface (cap-side surface) 28*b* of the cover body 28 so as to bias the power-supply brushes 31*a* and 31*b* toward the slip rings 26*a* and 26*b*.

Herein, the pigtail harnesses are set to a length such that, even when the power-supply brushes 31*a* and 31*b* are pushed by spring forces of the torsion coil springs 32*a* and 32*b*, the power-supply brushes 31*a* and 31*b* do not fall off from the brush holders 30*a* and 31*b*.

A recessed groove 36*a* is formed in substantially the center of a rear surface (motor-side surface) of the cover body 28 so as to constitute a space for installation of the after-mentioned detected part 50 of the rotation sensor 35. The recessed groove 36*a* is recessed toward the front in the axial direction. An inner diameter of the recessed groove 36*a* is set larger than a front end portion 50*a* of the detected part 50 such that the front end portion 50*a* of the detected part 50 is inserted and placed in the recessed groove 36*a*. A depth of the recessed groove 36 is set slightly smaller than an axial length (thickness) of the cover body 28 such that there is a thin wall left at the bottom of the recessed groove 36*a*. A positioning protrusion 28*k* is formed integrally at around the center of an outer (front) surface of the thin bottom wall.

A large-diameter groove 36*b* is formed in a region of the cover body 28 around a peripheral edge of the recessed groove 36*a* so as to define a recess with an outer diameter larger than the inner diameter of the recessed groove 36*a*. As shown in FIG. 1, an inner diameter of the large-diameter groove 36*b* is set substantially equal to an outer diameter of the annular ring part 20*a*. Moreover, the large-diameter groove 36*b* is set to a depth from the center of the rear surface to an axially middle position of the cover body 28 (i.e. an opening edge of the recessed groove 36*a*).

The recessed groove 36*a* and the large-diameter groove 36*b* are deviated (offset) toward the outside (cap side) with respect to the position of contact of the tip end portions of the power-supply brushes 31*a* and 31*b* with the slip rings 26*a* and 26*b*. These grooves 36*a* and 36*b* cooperate as a labyrinth groove.

A power-supply connector 33 is integrally mounted on the cover body 28 for supply of power from the control unit to the power-supply brushes 31*a* and 31*b*. As shown in FIG. 6, terminals of the power-supply connector 33 are partially embedded in the cover body 28, with one end regions of the terminals being connected to the pigtail harnesses and the other end regions 33*a* and 33*b* of the terminals being exposed to the outside for connection to female connectors of the control unit.

A signal connector 34 is also integrally mounted on the connector body 28 for signal output from the rotation sensor 35 to the control unit. In the first embodiment, the power-supply connector 33 and the signal connector 34 protrude radially outwardly in parallel with each other from the lower side of the cover body 28. As in the case of the power-supply connector 33, terminals of the signal connector 34 are partially embedded in a portion of the cover body 28 within the elongated cut 28*j*, with one end regions 34 of the terminals being connected to the rotation sensor 35 and the other end regions 34*b* of the terminals being exposed to the outside for connection to female connectors of the control unit, as shown in FIGS. 1 and 6.

The reduction gear unit 12 is constituted by the driven member 9, the eccentric shaft part 39, a roller holding part 41 and a plurality of rollers 48 so as to reduce the rotation speed of the electric motor 8 and transmit the reduced rotation of the electric motor 8 to the camshaft 2.

Figure 3:
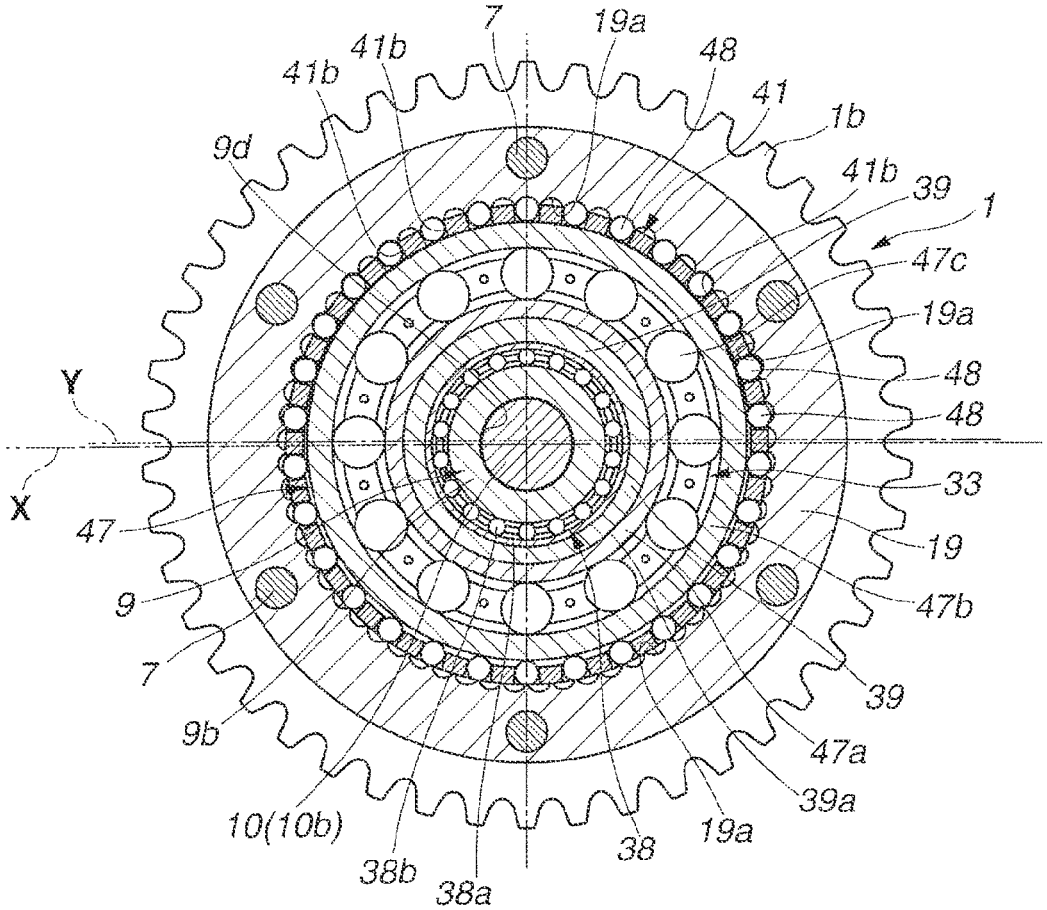
FIG. 3 is a cross section view of the valve timing control apparatus, as taken along line A-A of FIG. 1, according to the first embodiment of the present invention.

The eccentric shaft part 39 is eccentrically rotatable with the motor output shaft 13 as the eccentric shaft part 39 is made integral with the large-diameter portion 13*a* of the motor output shaft 13 as mentioned above. A cam surface 39*a* is formed on an outer circumferential surface of the eccentric shaft part 39 such that the center Y of the cam surface 39*a* is slightly radially eccentric to the center axis X of the motor output shaft 13 as shown in FIG. 3.

The roller holding part 41 is formed integrally on an outer circumference of the fixing end portion 9*a* of the driven member 9 (i.e. made of the same iron-based material as that of the driven member 9). As shown in FIG. 1, the roller holder part 41 is bent into a substantially L-like shape so as to protrude in the same direction as the circular cylindrical portion 9*b* of the driven member 9 and define a bottomed cylindrical profile.

A front end portion 41*a* of the roller holding part 41 extends toward the partition wall 5*b* of the motor housing 5 through an annular recessed space between the internal gear part 19 and the partition wall 5*b*. As shown in FIGS. 1 and 2, a plurality of roller holding holes 41*b* are formed in the front end portion 41*a* of the roller holding part 41 at circumferentially equally spaced positions. Each of the roller holding holes 41 is substantially rectangular in shape and axially elongated.

The rollers 48 are also made of an iron-based material and rotatably and radially movably held in the respective roller holding holes 41*b* of the roller holding part 41. Herein, the total number of the rollers 48 (roller holding holes 41*b*) is set smaller than the total number of the internal gear teeth 19*a* of the internal gear part 19 so as to establish a reduction gear ratio.

A small-diameter ball bearing 37 is disposed on the outer circumference of the shaft portion 10*b* of the cam bolt 10. A needle bearing 38 is disposed on the outer circumference of the circular cylindrical portion 9*b* of the driven member 9 at a position axially adjacent to the small-diameter ball bearing 37. The motor output shaft 13 and the eccentric shaft part 39 of the reduction gear unit 12 are rotatably supported via these bearings 37 and 38.

The small-diameter ball bearing 37 has an inner ring held between a front end edge of the circular cylindrical portion 9*b* of the driven member 9 and the bolt head portion 10*a* of the cam bolt 10, an outer ring press-fitted in the inner circumferential surface of the eccentric shaft part 39 and fixed in position by contact with a step of the inner circumferential surface of the eccentric shaft part 39 and a plurality of balls interposed between the inner ring and the outer ring.

The needle bearing 38 has a circular cylindrical retainer 38*a* press-fitted in an inner circumferential surface of the eccentric shaft part 39 and a plurality of needle rollers 38*b* (as rolling elements) rotatably held in the retainer 38*a* so as to roll over an outer circumferential surface of the circular cylindrical portion 9*b* of the driven member 9.

A middle-diameter ball bearing 47 is disposed between the outer circumference of the eccentric shaft part 39 and the rollers 48 and located such that the whole of the middle-diameter ball bearing 47 substantially radially overlap in position with the needle bearing 38.

As shown in FIG. 1, the middle-diameter ball bearing 47 has an inner ring 47*a* press-fitted on the outer circumferential surface of the eccentric shaft part 39, an outer ring 47*b* supported in a free state without being axially fixed and a plurality of balls interposed between the inner ring 47*a* and the outer ring 47*b*. More specifically, a front end face of the outer ring 47*b* is set free with no contact with any part or portion; a rear end face of the outer ring 47*b* is set free with a slight clearance C1 left between the rear end face of the outer ring 47 and the inner (front) surface of the roller holding part 41. Moreover, outer circumferential surfaces of the rollers 48 are brought into rolling contact with an outer circumferential surface of the outer ring 47*b*. As there is an annular clearance C2 left around the outer circumference of the outer ring 47*b*, the whole of the middle-diameter ball bearing 47 is radially movable with eccentric rotation of the eccentric shaft part 39, i.e., eccentrically movable to cause radial displacement of the rollers 48 for engagement with the internal gear teeth 19*a* and, at the same time, radial swinging motion of the rollers 48 as circumferentially guided by lateral edges of the roller holding holes 41*b* of the roller holding part 41.

There is provided a lubricating oil supply mechanism in the reduction gear unit 12 for supply of lubricating oil. The lubricating oil supply mechanism includes an oil supply passage formed in the bearing 02 of the cylinder head 01 to receive supply of the lubricating oil from a main gallery, an oil supply channel 59 formed axially in the camshaft 2 and connected at one end (as a groove) 59*a* thereof to the oil supply passage, an oil hole 59*c* having one end open at the other end (as a groove) 59*b* of the oil supply channel 59 and the other end open at the vicinity of the bearings 38 and 47 and an oil discharge hole formed through the driven member 9. By this lubricating oil supply mechanism, the lubricating oil is fed to and accumulated in an installation space 44 and then supplied to lubricate the middle-diameter ball bearing 47 and the rollers 48. The lubricating oil is further fed to the space between the motor output shaft 13 and the eccentric shaft part 39 and supplied to lubricate the small-diameter ball bearing 37 and the needle bearing 38.

A small-diameter oil seal 46 is interposed between the outer circumferential surface of the motor output shaft 13 and the inner circumferential surface of the extension portion 5*d* of the motor housing 5 so as to prevent the leakage of the lubricating oil from the reduction gear unit 12 into the electric motor 8. This oil seal 46 serves as a partition between the electric motor 8 and the reduction gear unit 12 by its seal function.

The rotation sensor 35 is situated between the small-diameter portion 13*b* of the motor output shaft 13 and the recessed groove 36*a* of the cover body 28.

In the first embodiment, the rotation sensor 35 is of the electromagnetic induction type, having two main component parts: detected part 50 and detecting part 51. The detected part 50 is fixed to the inside (i.e. bolt insertion hole 13*d*) of the small-diameter portion 13*b* of the motor output shaft 13 so as to rotate together with the motor output shaft 13. The detecting part 51 is fixed to substantially the center of the cover body 28 and configured to detect, from the detected part 50, a signal indicative of the rotation speed of the motor output shaft 13.

Figure 8:
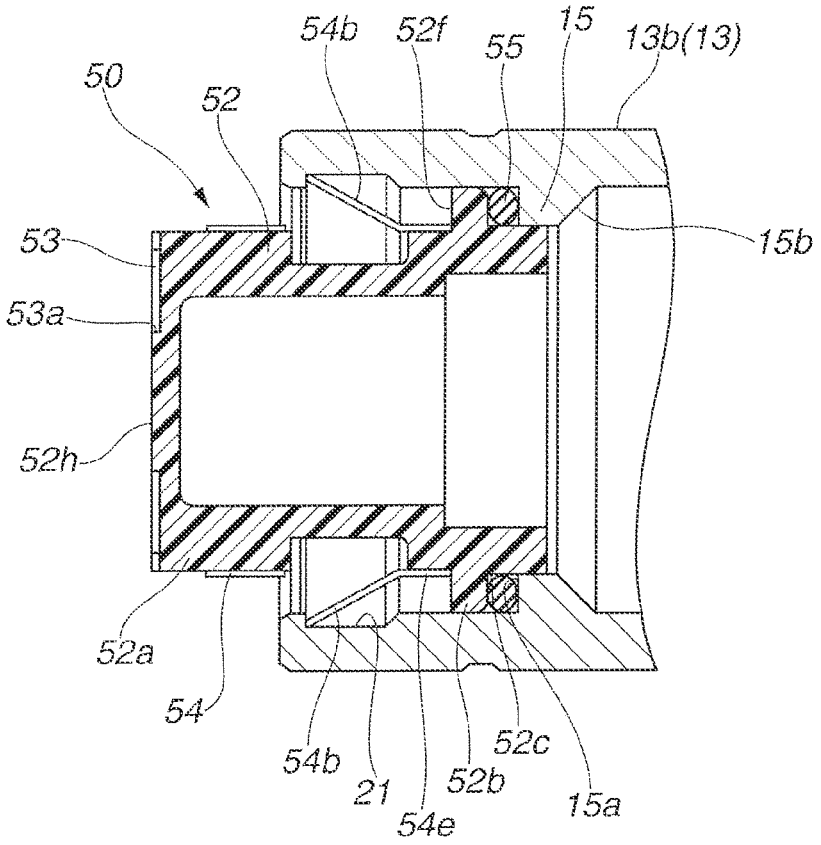
FIG. 8 is a schematic section view of a detected part of a rotational angle detection mechanism of the variable valve timing control apparatus, in a state of being mounted to the motor output shaft, according to the first embodiment of the present invention.
Figure 9A:
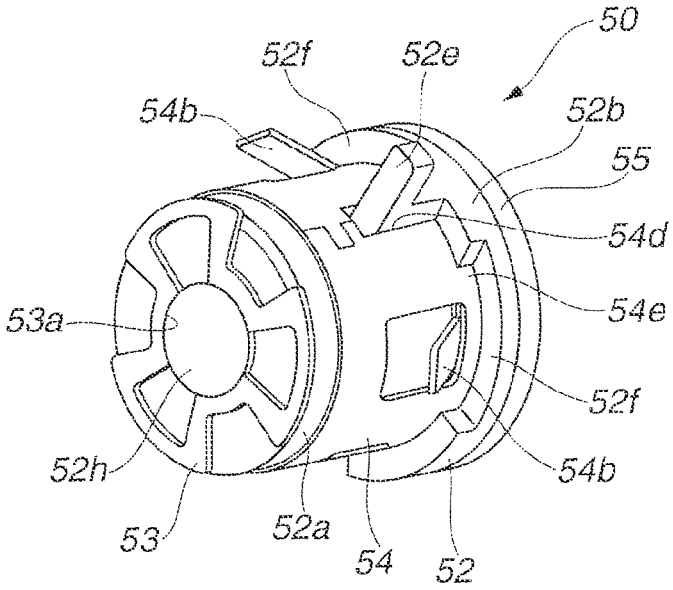
FIGS. 9A, 9B, 10A and 10B are a perspective view, a side view, a front view and a cross section view of the detected part of the rotational angle detection mechanism according to the first embodiment of the present invention, respectively.
Figure 9B:
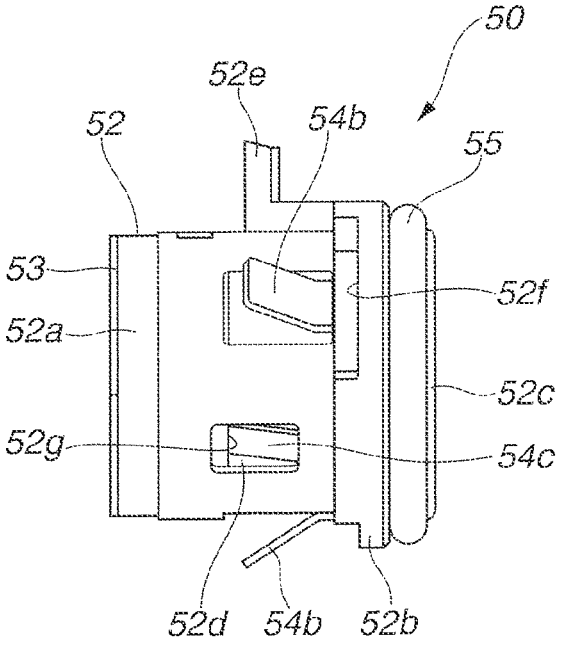
Figure 10A:
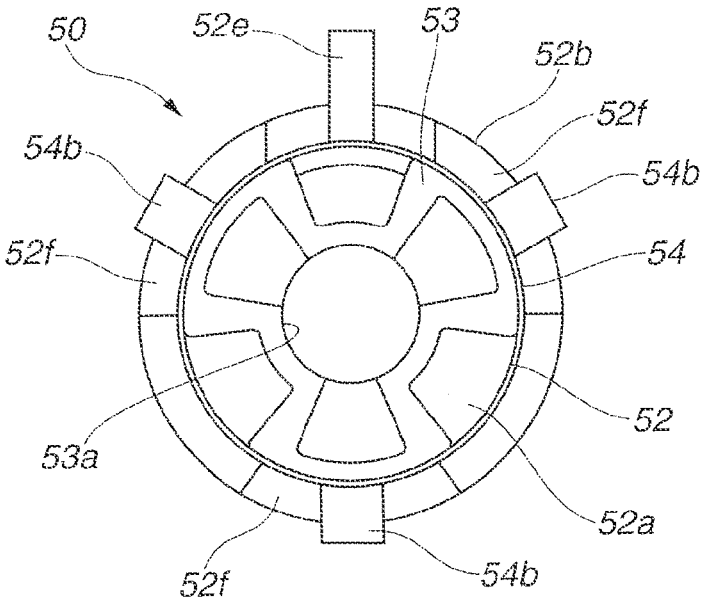
Figure 10B:
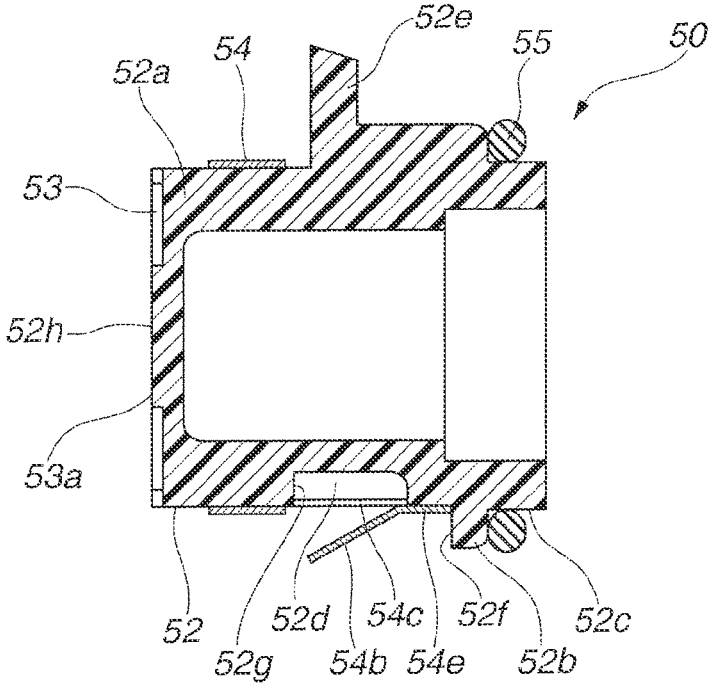

As shown in FIGS. 8 to 10, the detected part 50 includes a support body 52, a rotor 63 (as an exciting conductor), a fixing member 54 and an oil seal 55 (as a seal member).

The support body 52 is formed of a synthetic resin material in a substantially bottomed cylindrical shape, with a front end portion 52*a* thereof being closed, and is fixed at a rear end portion thereof in the small-diameter portion 13 of the motor output shaft 13.

Figure 11A:
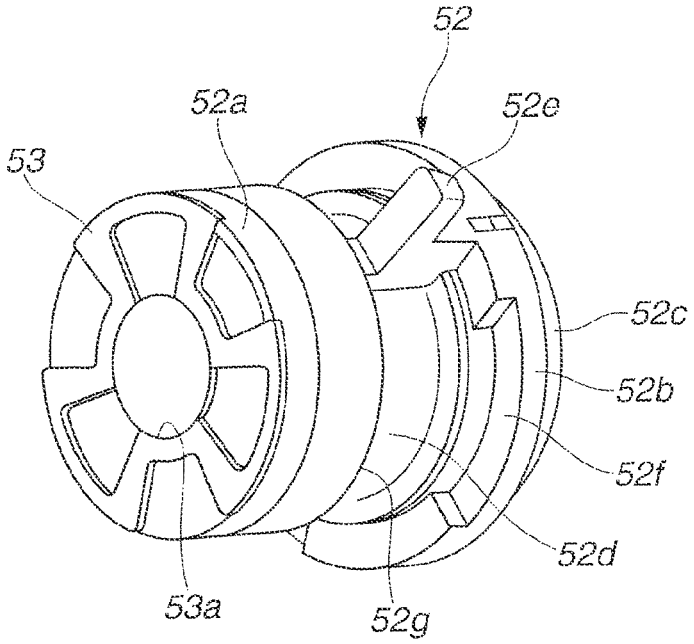
FIGS. 11A and 11B are a perspective view and a side view of a support body of the detected part of the rotational angle detection mechanism according to the first embodiment of the present invention, respectively.
Figure 11B:
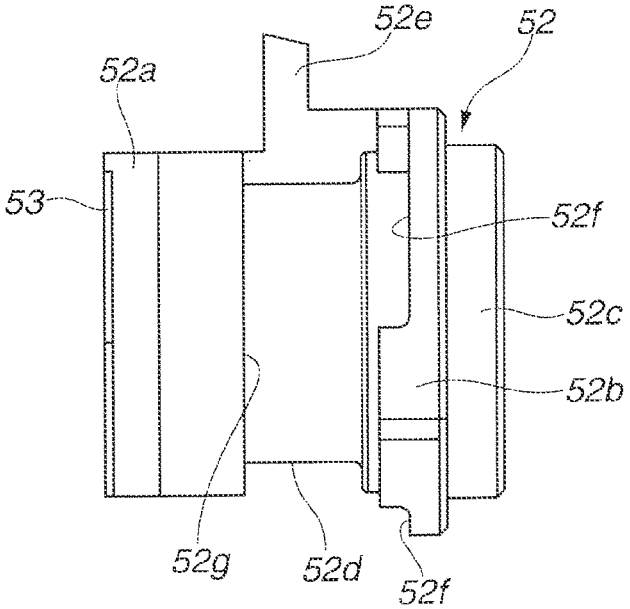

As shown in FIGS. 11 and 11B, an annular protrusion 52*b* is integrally formed on an outer circumference of the rear end portion of the support body 52. An annular seal retaining surface 52*c* is formed the support body 52 at a position rear of the protrusion 52*b* such that the annular oil seal 55 is retained on the seal retaining surface 52 and elastically brought into contact with an inner circumferential surface of the bolt insertion hole 13*d* to provide a seal between the bolt insertion hole 13*d* and the support body 52. An annular groove 52*d* is formed in the support body 52 at a position between the front end portion 52*a* and the protrusion 52*b*. A radially outward annular protrusion 52*e* (also referred to as "positioning protrusion") is formed integrally on an inner surface of the annular groove 52*d* so as to engage in the positioning groove 22 of the motor output shaft 13. The amount (length) of protrusion of the protrusion 52*e* is set such that, when the positioning protrusion 52*e* engages in the positioning groove 22, the positioning protrusion 52*e* slightly outwardly protrudes from the positioning groove 22 for proper positioning of the detected part 50 in the small-diameter portion 13*b* of the motor output shaft 13. Arc-shaped cuts 52*f* are formed in a front end face of the protrusion 52*b* at three circumferential positions spaced 120° apart from each other. A circular protrusion 52*h* is formed on the center of a front end face of the front end portion 52*a* (bottom wall) of the support body 52

As also shown in FIGS. 11A and 11B, the rotor 53 is formed by bending a thin magnetic material into a noncircular shape such as three-leaf shape with a circular center hole 53*a* of relatively large diameter. An overall outer diameter of the rotor 53 is set slightly smaller than an outer diameter of the front end portion 52*a* of the support body 52. The rotor 53 is fixed to the front end face of the front end portion 52*a* (i.e. the outer surface of the bottom wall) of the support body 52 by engaging the circular protrusion 52*h* in the circular hole 53*a* and resin-molding an outer peripheral edge of the circular protrusion 52*h* to a peripheral edge region of the circular hole 53*a*.

In a state that the support body 52 is fixed in the small-diameter portion 13*b* of the motor output shaft 13, the front end portion 52*a* of the support body 52 protrudes from the front end of the small-diameter portion 13*b* of the motor output shaft 13 such that the rotor 53 remains exposed to the front from the small-diameter portion 13*b* of the motor output shaft 13.

The fixing member 54 is fitted around an outer circumference of the support body 52. By this fixing member 54, the support body 52 is fixed in position within the small-diameter portion 13 of the motor output shaft 13.

Figure 12A:
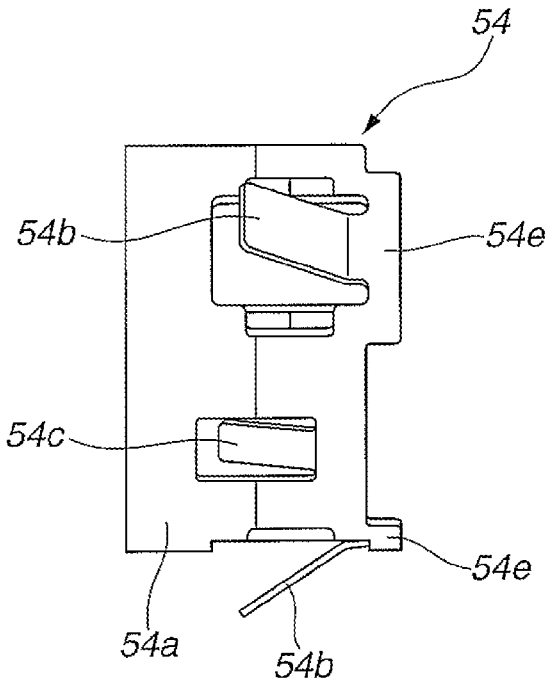
FIGS. 12A and 12B are a side view and a front view of a fixing member of the detected part of the rotational angle detection mechanism according to the first embodiment of the present invention, respectively.
Figure 12B:
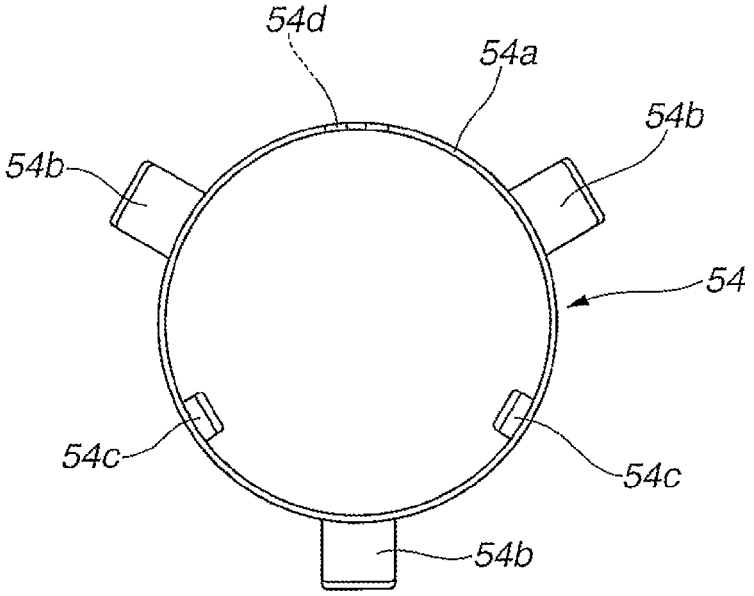

As shown in FIGS. 12A and 12B, the fixing member 54 has a fixing body 54*a*, three locking pieces 54*b* and two engagement pieces 54*c*.

The fixing body 54*a* is formed by bending a thin metal material into a substantially circular cylindrical shape. An inner diameter of the fixing body 54*a* is set substantially equal to an outer diameter of the support body 52 so as to allow insertion of the support body 52 therein from the front end side while keeping contact between an inner circumferential surface of the fixing body 54*a* and an outer circumferential surface of the support body 52. An engagement slit 54*d* is axially formed in a rear end portion of the fixing body 54*a* from the rear end toward the front such that the positioning protrusion 52*e* of the support body 52 engages in the engagement slit 54*d*. Arc-shaped protrusions 54*e* are formed on the rear end portion of the fixing body 54*a* at three circumferential positions spaced 120° apart from each other so as to axially engage in the respective cuts 52*f* of the support body 52.

The locking pieces 54*b* and the engagement pieces 54*c* are formed by cutting and bending on a substantially axially middle portion of the fixing body 54*a*

The locking pieces 54*b* are located at positions circumferentially spaced about 120° from each other. Each of the locking pieces 54*b* has an axially elongated rectangular shape with a relatively large width and extends in a radially outwardly inclined manner from its rear base end. These locking pieces 54*b* are radially inwardly elastically deformable about their respective rear base ends.

The engagement pieces 54*c* are located at circumferential positions between the locking pieces 54*b*. Each of the engagement pieces 54 has an axially elongated rectangular shape with a relatively small width and extends in a radially inwardly inclined manner from its rear base end. These engagement pieces 54*c* are radially outwardly elastically deformable about their respective rear base ends.

The above detected part 50 is fixed to the motor output shaft 13 by the following procedure.

To fit the fixing member 54 on the outer circumferential surface of the support body 52, the positioning protrusion 52*e* of the support body 52 is inserted and engages in the engagement slit 54*d* of the fixing member 54. By insertion of the positioning protrusion 52*e* in the engagement slit 54*d*, the engagement pieces 54*c* slide over the outer circumferential surface of the support body 52 and become outwardly elastically deformed against their own elastic forces. When the fixing member 54 is set to its maximum insertion position by contact of the rear end of the fixing member 54 with the front end face of the protrusion 52*b*, the engagement pieces 54*c* becomes inwardly elastically deformed back such that front tip ends of the engagement pieces 54*c* engage in the annular groove 52*d* and are locked by a stepped surface 52*g* of the locking groove 21 (see e.g. FIG. 9B). Consequently, the axial displacement of the fixing member 54 is restricted by the protrusion 52*b* and the stepped surface 52*g*; and the circumferential displacement of the fixing member 54 is restricted by the positioning protrusion 52*e*. The fixing member 54 is thus properly placed in position on the outer circumferential surface of the support body 52. At this time, the circumferential positioning of the fixing member 54 relative to the support body 52 is done by engagement of the arc-shaped protrusions 54*e* of the fixing body 54*a* in the cuts 52*f* of the support body 52.

The oil seal 55 is elastically retained in advance on the seal retaining surface 52*c* of the support body 22 so as to perform its seal function and act as a plug. The rotor 53 is resin-molded to the front end face of the support body 52.

In this way, the detected part 50 is assembled as an assembly unit in which the fixing member 54 and the oil seal 55 are fitted on the support body 52 with the rotor 53 attached to the support body 52 as shown in FIGS. 9A, 9B, 10A and 10B.

To fix the thus-assembled detected part 50 in the small-diameter portion 13*b* of the motor output shaft 13, the detected part 50 is inserted into the small-diameter portion 13*b* (bolt insertion hole 13*d*) of the motor output shaft 13 from the front end side. By insertion of the detected part 50, the locking pieces 54*b* of the fixing member 54 slide over the inner circumferential surface of the small-diameter portion 13*b* and become inwardly elastically deformed against their own elastic forces. When the locking pieces 54*b* reach the locking groove 21 of the motor output shaft 13 by further insertion of the detected part 50, the locking pieces 54*b* becomes outwardly elastically deformed back within the locking groove 21. Simultaneously, the oil seal 55 comes into elastic contact with the front end face 15*a* of the annular protrusion 15 of the motor output shaft 13 and push the support body 52 back toward the front through the protrusion 52*b*. In consequence, the locking pieces 54*b* are axially locked at front tip ends thereof by a stepped edge of the locking groove 21. The axial displacement of the detected part 50 is restricted by such locking forces of the locking pieces 54*b* and elastic force of the oil seal 55. The detected part 50 is thus properly and assuredly fixed in position within the small-diameter portion 13*b* of the motor output shaft 13.

Figure 13A:
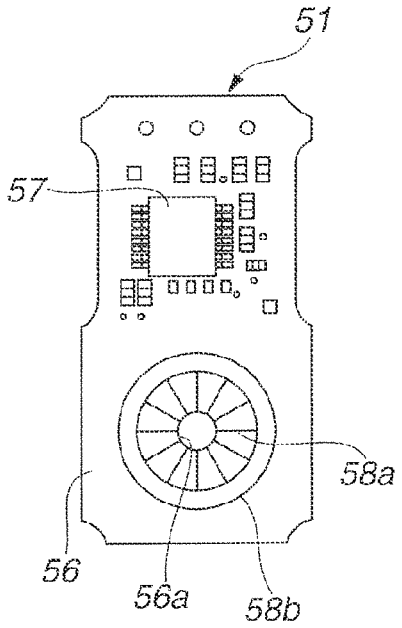
FIGS. 13A, 13B and 13C are a front view, a side view and a back view of a detecting part of the rotational angle detection mechanism of the variable valve timing control apparatus according to the first embodiment of the present invention, respectively.
Figure 13B:
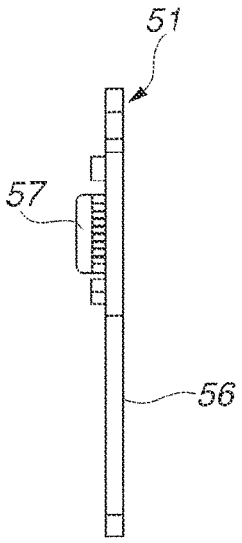
Figure 13C:
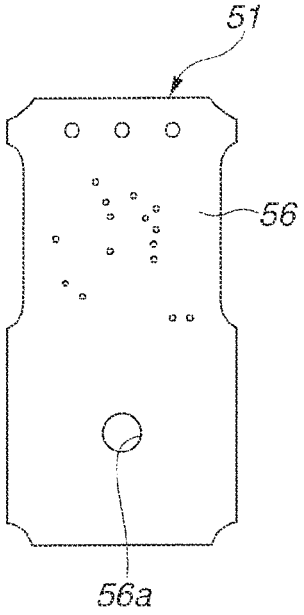

On the other hand, the detecting part 51 includes a printed circuit board 56, an integrated circuit (ASIC) 57, a receiving coil 58*a* and an exciting coil 58*b* as shown in FIGS. 1 and 13.

The printed circuit board 56 is substantially rectangular-shaped and disposed on a substantially radially middle portion of the cover body 28.

The integrated circuit 57 is mounted as a detection circuit on one longitudinal end region of a rear surface (motor-side surface) of the printed circuit board 56.

The receiving and exciting coils 58*a* and 58*b* are mounted on the other longitudinal end region of the rear side of the printed circuit board 56.

A small positioning hole 56*a* is formed in the other longitudinal end portion of the printed circuit board 56 for positioning of the receiving and exciting coils 58*a* and 58*b*. By press-fitting of the positioning protrusion 28*k* of the cover body 28 in the positioning hole 56*a* of the printed circuit board 56, the center of the rotor 53 and the center of the receiving and exciting coils 58*a* and 58*b* are properly aligned with each other. As the printed circuit board 56 is bonded and fixed to the front end face of the cover body 28 by a predetermined bonding means such as soldering, the receiving and exciting coils 58*a* and 58*b* axially face the bottom wall of the recessed groove 36*a* with a slight clearance C left therebetween.

Thus, the above detecting part 51 is so configured that, when there occurs a change in inductance between the receiving coil 58*a* and the rotor 53 by the flow of an induction current between the exciting coil 58*b* and the rotor 53, the integrated circuit 57 detects the rotational angle of the motor output shaft 13 based on such electromagnetic induction action and outputs the detected information signal to the control unit.

The control unit receives various information signals from the rotation sensor 35 and other sensors such as crank angle sensor, airflow meter, coolant temperature sensor, accelerator opening sensor etc., determines the current operation status of the internal combustion engine (including the current rotational position of the motor output shaft 13) based on these information signals and performs not only operation control of the internal combustion engine, but also drive control of the electric motor 8 by supply of power to the motor coil 18 via the power-supply brushes 31*a* and 31*b*, the slip rings 26*a* and 26*b*, the switching brushes 25*a* and 25*b* and the commutator 20 etc. to control the relative rotational phase of the timing sprocket 1 and the camshaft 2 through the reduction gear unit 12, in accordance with the detected current engine operation status.

The operations of the above-structured valve timing control apparatus will be explained below.

The timing sprocket 1 is rotated by the engine crankshaft via the timing chain. As the rotation of the timing sprocket 1 is transmitted to the motor housing 5 via the internal gear part 19, the motor housing 5 is rotated in synchronism with the timing sprocket 1. On the other hand, the rotation of the internal gear part 19 is transmitted to the camshaft 2 via the roller holding part 41 and the driven member 9. As the camshaft 2 is rotated by such rotational force, the intake valves are opened and closed by the drive cams of the camshaft 2.

In a predetermined engine operation state after the engine start, power is supplied from the control unit to the coil 18 of the electric motor 8 via the terminals of the power-supply connector 33, the pigtail harnesses, the power-supply brushes 31*a* and 31*b*, the slip rings 26*a* and 26*b* etc. By the power supply, the electric motor 8 is driven to cause rotation of the motor output shaft 13. The rotation of the motor output shaft 13 is reduced by the reduction gear unit 12 and then transmitted to the camshaft 2. More specifically, the eccentric shaft part 39 of the reduction gear unit 12 is eccentrically rotated with the rotation of the motor output shaft 13. Each of the rollers 48 rolls over one internal gear tooth 19*a* to another adjacent internal gear tooth 19*a* of the internal gear part 19, while being guided by the corresponding roller holding hole 41*b* of the roller holding part 41, per one turn of the motor output shaft 13. The rollers 48 repeat this rolling motion and circumferentially roll in contact with the internal gear teeth 19*a*. By such rolling contact of the rollers 48, the rotation of the motor output shaft 13 is reduced and transmitted to the driven member 9 and then to the camshaft 2. At this time, the reduction gear ratio can be set as appropriate according to a difference between the number of the internal gear teeth 19*a* and the number of the rollers 48.

As a result, the camshaft 2 is rotated forward or reverse relative to the timing sprocket 1 so as to change the relative rotational phase of the timing sprocket 1 (crankshaft) and the camshaft 2 and thereby advance or retard the opening and closing timing of the intake valves. As mentioned above, the maximum advanced and retarded rotational positions of the camshaft 2 relative to the timing sprocket 1 can be restricted by contact of the side edge of the stopper protrusion 71*b* with the circumferential edge 2*c* of the stopper recess 2*b*. It is therefore possible to control the opening and closing timing of the intake valves to the maximum advanced position or maximum retarded position and improve the fuel efficiency and output performance of the internal combustion engine.

In the first embodiment, the valve timing control apparatus is characterized in that the rotation sensor 35 is of the electromagnetic induction type as mentioned above. In this electromagnetic induction type rotation sensor 35, the integrated circuit 54 detects the current rotational angle of the motor output shaft 13 by the electromagnetic induction action between the detected part 50 and the detecting part 51, even without rotation of the motor output shaft 13 of the electric motor 8, such that the control unit can determine the current rotational position of the motor output shaft 13 based on the detection signal from the integrated circuit 54.

Namely, the rotation sensor 35 is able to detect the current rotational angle of the motor output shaft 13 by the electromagnetic induction action between the detected part 50 and the detecting part 51 even when the electric motor 8 is not driven (i.e. the motor output shaft 13 is not rotated) e.g. during idling stop of the internal combustion engine.

By the adoption of such an electromagnetic induction type rotation sensor 35, it is possible to avoid the influence of a magnetic field caused by the electric motor 8, accurately detect the rotational angle of the motor output shaft 13 with increase of detection resolution at all times regardless of the operation/stop status of the internal combustion engine and thereby accurately control the relative rotational phase of the camshaft 2 relative to the crankshaft according to the culTent operation status of the internal combustion engine.

In the first embodiment, the front end portion 50*a* of the detected part 50 (the front end portion 52*a* of the support body 52) is placed in the recessed groove 36*a* of the cover body 28 such that the rotor 53 of the detected part 50 is offset toward the outside (cap side) with respect to the position of sliding contact of the power-supply brushes 31*a* and 31*b* with the slip rings 26*a* and 26*b*. In this configuration, the rotor 53 is covered by the inner circumferential surfaces of the recessed groove 36*a* and the large-diameter groove 36*b* of the cover body 28. Even when there occurs metal abrasion powder due to sliding contact between the power-supply brushes 31*a* and 31*b* and the slip rings 26*a* and 26*b*, the rotor 53 can be adequately protected from adhesion of metal abrasion powder. In particular, the recessed groove 36*a* and the large-diameter groove 36*b* cooperate as a labyrinth groove in the first embodiment. The flow of metal abrasion powder to the front end portion 52*a* of the support body 52 and to the rotor 53 can be suppressed by the effect of the labyrinth groove. It is thus possible to prevent the detection accuracy of the rotation sensor 35 from deteriorating under the influence of metal abrasion powder for improvement of durability.

As the cover member 4 is made axially thin in the first embodiment, the overall axial dimension of the valve timing control apparatus can be sufficiently reduced. It is thus possible to achieve downsizing of the valve timing control apparatus and improve the mountability of the valve timing control apparatus in engine room.

Further, the support body 52 of the detected part 50 is fixed in the small-diameter portion 13*b* of the motor output shaft 13 by the fixing member 54 in the first embodiment. It is thus possible to ensure stable and secure fixing of the detected part 50 as well as proper axial and radial positioning of the detected part 50. It is also possible to reduce the overall axial dimension of the valve timing control apparatus and improve the mountability of the valve timing control apparatus in the engine room as the support body 52 of the detected part 50 is fixed by insertion into the bolt insertion hole 13*d* of the motor output shaft 13.

In addition, the fixing member 54 can be fixed in position on the support body 52 by means of the engagement pieces 54*c* at one touch operation; and the detected part 50 (the assembly unit of the support body 52 and the fixing member 54) can be fixed in position in the small-diameter portion 13*b* of the motor output shaft 13 by means of the locking pieces 54*b* at one touch operation in the first embodiment. The fixing of the detected part 50 to the motor output shaft 13 is thus made very easy.

Conventionally, it has been necessary to place a plug in the bolt insertion hole of the motor output shaft in order to prevent the flow of the lubricating oil from the reduction gear unit to the electric motor through the bolt insertion hole. In the first embodiment, however, the detected part 50 has the seal function to plug the bolt insertion hole 13*d*. There is thus no need to separately provide a plug in the bolt insertion hole 13*d* in the first embodiment.

[Second Embodiment]

Figure 14:
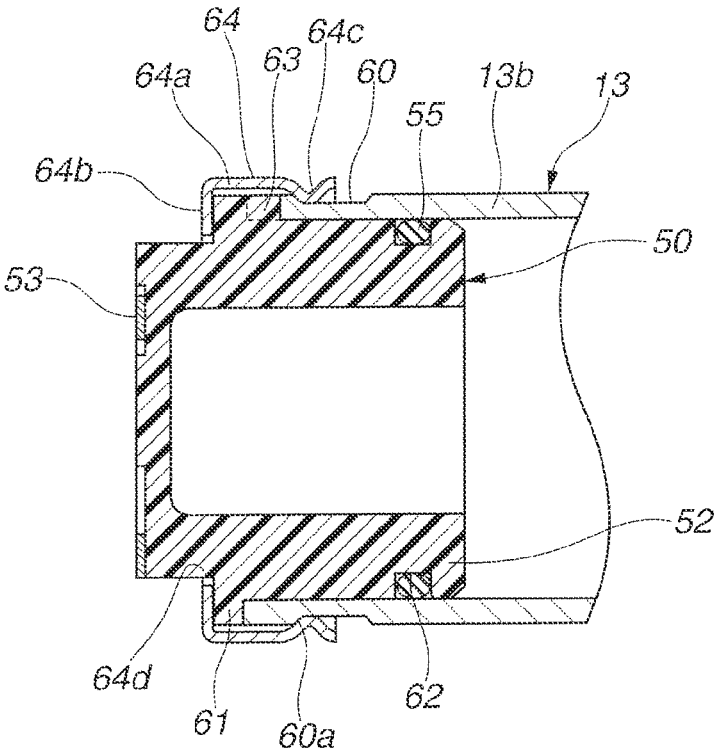
FIG. 14 is a schematic section view of a detected part of a rotational angle detection mechanism, in a state of being mounted to a motor output shaft of an electric motor, of a variable valve timing control apparatus according to a second embodiment of the present invention.

The second embodiment is structurally similar to the first embodiment, except for the fixing structure between the small-diameter portion 13*b* of the motor output shaft 13 and the detected part 50 of the rotation sensor 35, as shown in FIG. 14.

Figure 15A:
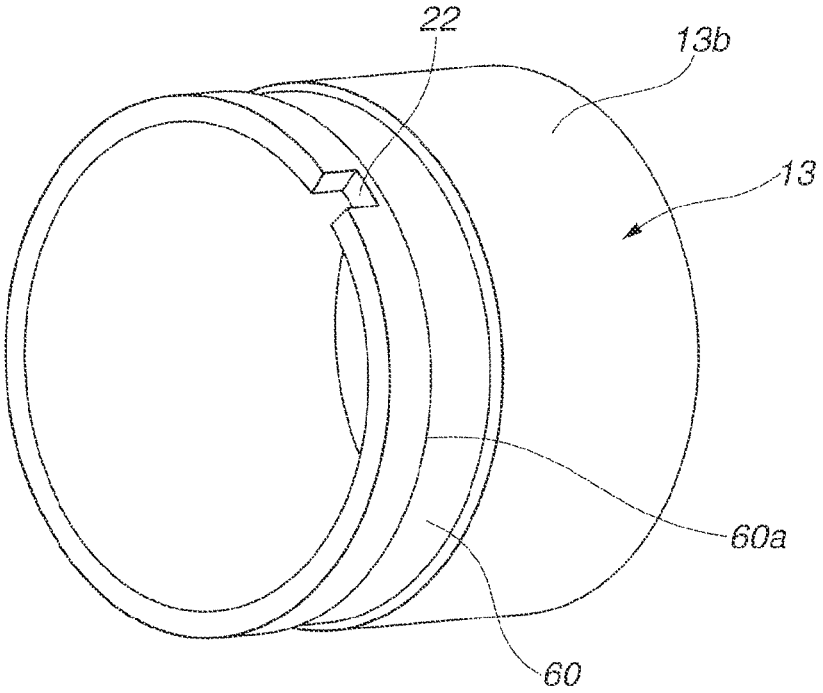
FIGS. 15A and 15B are a perspective view and a side view of a main part of the motor output shaft according to the second embodiment of the present invention, respectively.
Figure 15B:
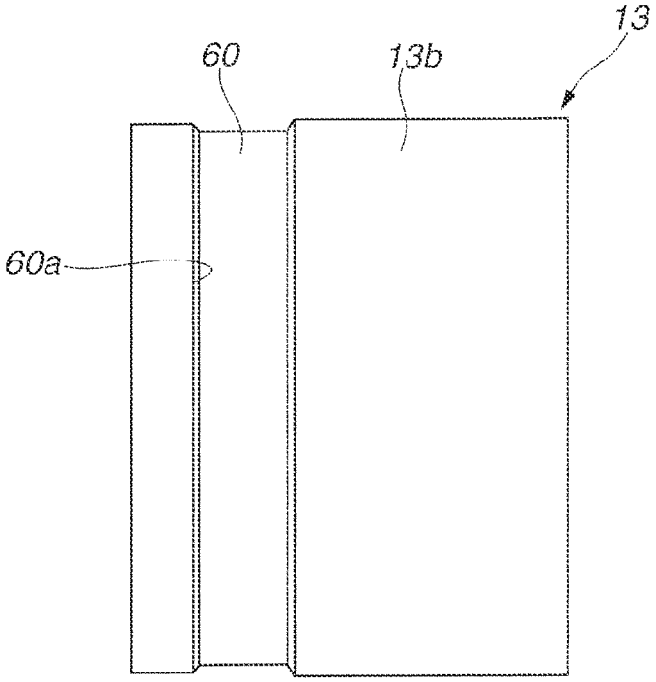

More specifically, an annular engagement groove 60 is formed in a front end region of the outer circumferential surface of the small-diameter portion 13*b* of the motor output shaft 13 as shown in FIGS. 15A and 15B. The positioning groove 22 is formed axially in the small-diameter portion 13*b* so as to extend from the front edge of the small-diameter portion 13*b* to the engagement groove 60.

Figure 16A:
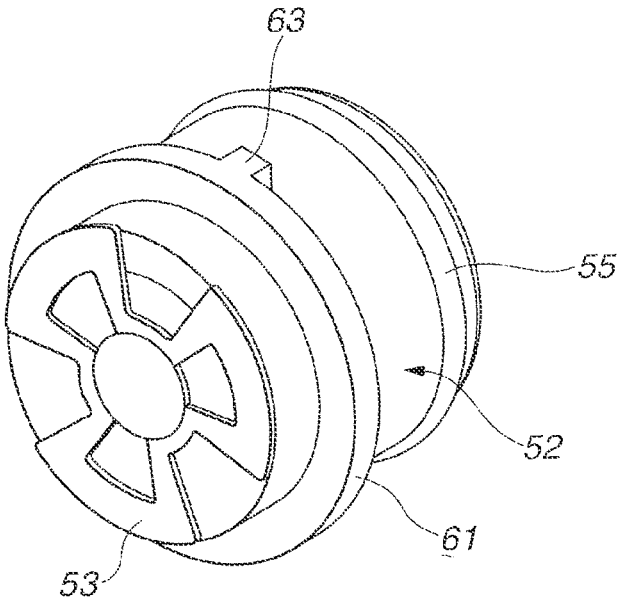
FIGS. 16A and 16B are a perspective view and a side view of a support body of the detected part of the rotational angle detection mechanism according to the second embodiment of the present invention, respectively.
Figure 16B:
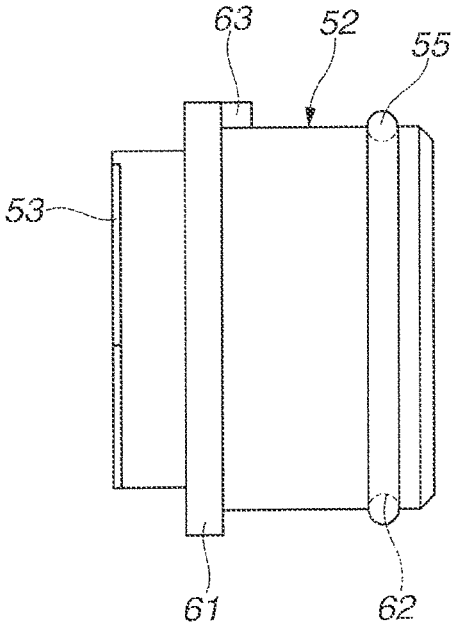

As shown in FIGS. 16A and 16B, on the other hand, an annular protrusion 61 (as an annular stopper) is formed integrally on an outer circumferential surface of the front end portion of the support body 52 of the detected part 50. An annular seal groove 62 is formed in an outer circumferential surface of the rear end portion of the support body 52 such that the oil seal 55 is fitted and retained in the seal groove 62. A positioning protrusion 63 is also formed on a rear end face of the annular protrusion 61 so as to extend axially toward the rear and engage in the positioning groove 22.

In the second embodiment, the support body 52 of the detected part 50 is fixed in the small-diameter portion 13*b* of the motor output shaft 13 by fitting a fixing member 64 over an outer circumferential surface of the annular protrusion 61 and a front region of the engagement groove 60 of the motor output shaft 13.

Figure 17A:
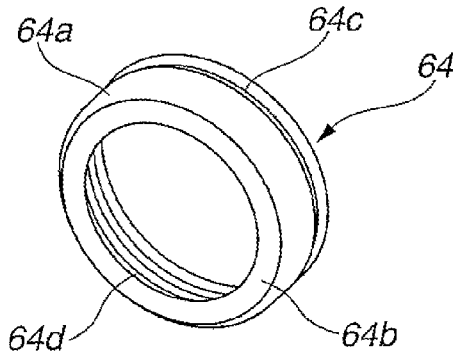
FIGS. 17A, 17B and 17C are a perspective view, a side view and a cross section view of a fixing member of the detected part of the rotational angle detection mechanism according to the second embodiment of the present invention, respectively.
Figure 17B:
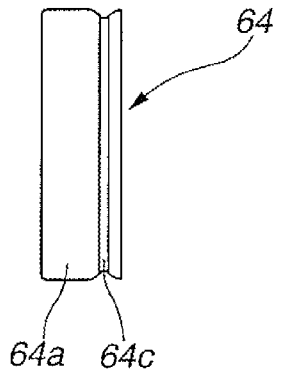
Figure 17C:
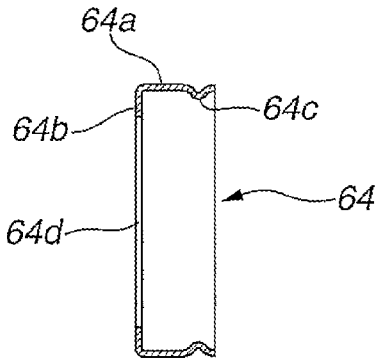

As shown in FIGS. 17A to 17C, the fixing member 64 has a fixing body 64*a* formed by bending a thin metal material into a substantially annular circular shape, a circular portion 64*b* formed with a center through hole 64*d* at a front end of the fixing body 64*a* by bending in a substantially L-like cross-section shape and axially fitted to the annular protrusion 61 and an engagement portion 64*c* formed at a rear end of the fixing body 64*a* by bending into a substantially U-like cross-section shape so as to engage in the engagement groove 60. An inner diameter of the fixing body 64*a* is set slightly larger than an outer diameter of the annular protrusion 61. A diameter (radial dimension) of the circular portion 64*b* is set slightly smaller than the diameter of the annular protrusion 61. The engagement portion 64*c* is made elastically deformable in its entirety through the fixing body 64*a* so as to engage in the engagement groove 60 by its own elastic force.

The rotor 53 is fixed by resin molding to the bottom wall of the front end portion of the support body 52 as in the case of the first embodiment.

Thus, the detected part 50 is fixed in the small-diameter portion 13*b* of the motor output shaft 13 by the following procedure.

The rear end portion of the support body 52 is first fitted in the small-diameter portion 13*b* (bolt insertion hole 13*d*) of the motor output shaft 13. At this time, the positioning protrusion 63 is axially inserted and engages in the positioning groove 22 until the annular protrusion 61 abuts the front end of the small-diameter portion 13*b*. The circumferential and axial positioning of the detected part 50 relative to the small-diameter portion 13 is done by such insertion and engagement.

Next, the support body 52 is inserted in the fixing member 64 from the rear side. When the front end portion of the support body 52 passes through the center through hole 64*d* of the circular portion 64*b*, the engagement portion 64*c* of the fixing member 64 becomes outwardly deformed against its own elastic force and slides over the outer circumferential surface of the annular protrusion 61 of the support body 52 and over the outer circumferential surface of the front region of the small-diameter portion 13*b* of the motor output shaft 13. When the engagement portion 64*c* reaches the engagement groove 60, the engagement portion 64*c* becomes inwardly deformed by its own elastic force and engages in the engagement groove 60 as shown in FIG. 14. Simultaneously, a rear end face of the circular portion 64*b* is brought into contact with a front end face of the annular protrusion 61 so as to restrict further insertion of the support body 52 into the fixing member 64. Further, the engagement portion 64*c* is axially brought into press contact with a front edge 60*a* of the engagement groove 60 so as to ensure secure engagement of the engagement portion 64*c* in the engagement groove 60.

As mentioned above, the fixing member 64 of simple shape is used for fixing of the detected part 50 to the motor output shaft 13 in the second embodiment. It is therefore possible to achieve simplification of structure and improvement of manufacturing efficiency as compared to the first embodiment. It is also possible to further facilitate the fixing of the detected part 50 to the motor output shaft 13 as the support body 52 of the detected part 50 can be securely fixed in the small-diameter portion 13*b* of the motor output shaft 13 by the fixing member 64 at one touch operation.

As the other configurations of the second embodiment are the same as those of the first embodiment, it is possible in the second embodiment to obtain the same functions and effects of those configurations as in the first embodiment.

The present invention is based on Japanese Patent Application No. 2014-223932 (filed on Nov. 4, 2014) of which the entire contents are herein incorporated by reference.

Although the present invention has been described with reference to the above exemplary embodiments, it will be understood that the present invention is not limited to these exemplary embodiments. Various changes and modifications of the embodiments described above will occur to those skilled in the art in light of the above teachings. For example, it is possible in the present invention to apply the valve timing control apparatus to the exhaust system of the internal combustion engine although the valve timing control apparatus is applied to the intake system of the internal combustion engine in the above embodiments. There can be used another fixing structure between the detected part 50 of the rotation sensor 35 and the small-diameter portion 13*b* of the motor output shaft 13. It is also to utilize a timing pulley as the driving rotation member although the timing sprocket 1 is utilized as the driving rotation member in the above embodiments. The scope of the present invention is defined with reference to the following claims.

What is claimed is:

1. A valve timing control apparatus for an internal combustion engine, comprising:

a driving rotation member to which rotation of a crankshaft is transmitted;

a driven rotation member coupled to a camshaft so as to be rotatable relative to the driving rotation member;

an electric motor having a motor output shaft to cause rotation of the driven rotation member relative to the driving rotation member;

a cover member arranged axially facing a front end portion of the motor output shaft; and an electromagnetic induction type rotational angle detection mechanism disposed between the motor output shaft and the cover member so as to detect a rotational angle of the motor output shaft, wherein the rotational angle detection mechanism comprises:

a detected part provided to the front end portion of the motor output shaft; and a detecting part provided to a portion of the cover member axially facing the detected part;

wherein the detected part has a noncircular exciting conductor;

wherein the detecting part has a receiving coil, an exciting coil and a detection circuit to detect a change in inductance between the receiving coil and the exciting conductor and determine the rotational angle of the motor output shaft based on the detected change in inductance;

wherein a bolt insertion hole is formed axially in the motor output shaft such that a cam bolt is inserted in the bolt insertion hole;

wherein the detected part is partially inserted in the bolt insertion hole; and wherein the exciting conductor is fixed to a front end face of the detected part.

2. The valve timing control apparatus according to claim 1, wherein the detected part has a substantially cylindrical support body arranged such that a rear end portion of the support body is inserted and fixed in the bolt insertion hole.

3. The valve timing control apparatus according to claim 1, wherein the detected part has a seal member retained at an outer circumference thereof and elastically brought into contact with an inner circumferential surface of the bolt insertion hole so as to provide a seal between the detected part and the bolt insertion hole.

4. The valve timing control apparatus according to claim 3, wherein the motor output shaft has an annular protrusion formed integrally on the inner circumferential surface of the bolt insertion hole and a locking groove formed in the inner circumferential surface of the bolt insertion hole at a position front of the annular protrusion;

wherein the seal member is axially elastically brought into contact with the annular protrusion; and wherein the detected part has a locking piece formed on an outer circumferential surface of the support body at a position front of the seal member so as to engage in the locking groove by axial elastic reaction force of the seal member.

5. The valve timing control apparatus according to claim 2, wherein the support body has an annular stopper formed on an outer circumferential surface thereof for positioning of the support body in the bolt insertion hole; and wherein the detected part has a fixing member arranged to cover an outer circumferential surface of the annular stopper and fix the support body to the front end portion of the motor output shaft.

6. The valve timing control apparatus according to claim 1, wherein the detected part has a cylindrical support body formed of a synthetic resin material; and wherein the exciting conductor is fixed by resin molding to a front end face of the support body.

7. The valve timing control apparatus according to claim 6, wherein the detected part has a seal member retained around a rear end portion of the support body to provide a seal between an outer circumferential surface of the support body and an inner circumferential surface of the motor output shaft.

8. The valve timing control apparatus according to claim 6, wherein the support body is formed into a bottomed cylindrical shape with a bottom wall; and wherein the exciting conductor is fixed by resin molding to an outer surface of the bottom wall of the support body.

9. The valve timing control apparatus according to claim 8, wherein the detecting part is fixed to the cover member; and wherein a resin material is arranged between the detecting part and the detected part.

10. A valve timing control apparatus for an internal combustion engine, comprising:

a driving rotation member to which rotation of a crankshaft is transmitted;

a driven rotation member coupled to a camshaft by a cam bolt so as to be rotatable relative to the driving rotation member;

an electric motor integrally mounted on the driving rotation member and having a motor rotation shaft rotated to cause rotation of the driven rotation member relative to the driving rotation member;

a cover member arranged axially facing a front end portion of the motor output shaft; and an electromagnetic induction type rotational angle detection mechanism disposed between the motor output shaft and the cover member so as to detect a rotational angle of the motor output shaft, wherein the rotational angle detection mechanism comprises:

a detected part provided to the front end portion of the motor output shaft and having an exciting conductor fixed to a front end face of the detected part;

a circuit board fixed to the cover member;

receiving and exciting coils mounted on the circuit board; and a detection circuit mounted on the circuit board to detect a change in inductance between the receiving coil and the exciting conductor and determine the rotational angle of the motor output shaft based on the detected change in inductance, wherein a bolt insertion hole is formed axially in the motor output shaft such that the cam bolt is inserted in the bolt insertion hole; and wherein the detected part is partially inserted in a front end region of the bolt insertion hole, with the exciting conductor remaining exposed from the front end region of the bolt insertion hole.

11. The valve timing control apparatus according to claim 10, wherein the detected part has a cylindrical support body formed of a synthetic resin material; and wherein the exciting conductor is fixed by resin molding to a front end face of the support body.

* * * * *